US008931539B1

(12) United States Patent
Jaggli

(10) Patent No.: US 8,931,539 B1
(45) Date of Patent: Jan. 13, 2015

(54) CORD SAFETY DEVICE FOR WINDOW COVERINGS

(71) Applicant: David Louis Jaggli, Huntington Beach, CA (US)

(72) Inventor: David Louis Jaggli, Huntington Beach, CA (US)

( * ) Notice: Subject to any disclaimer, the term of this patent is extended or adjusted under 35 U.S.C. 154(b) by 17 days.

(21) Appl. No.: 13/933,125

(22) Filed: Jul. 2, 2013

(51) Int. Cl.
*E06B 9/322* (2006.01)
*E06B 9/326* (2006.01)

(52) U.S. Cl.
CPC ..... *E06B 9/326* (2013.01)
USPC ..... 160/168.1 R; 160/178.1 R

(58) Field of Classification Search
CPC ..... E06B 9/326
USPC ..... 160/168.1 R, 173 R, 170; 267/74
See application file for complete search history.

(56) References Cited

U.S. PATENT DOCUMENTS 1,578,817 A * 3/1926 Fischer ..... 24/300
2,594,637 A * 4/1952 Gertzon ..... 160/168.1 R
2,748,852 A * 6/1956 Akerstrom ..... 160/168.1 R
2,786,522 A * 3/1957 Weber ..... 160/345
2,994,300 A * 8/1961 Grahling ..... 119/770
5,495,883 A * 3/1996 Jelic ..... 160/84.04
5,613,540 A * 3/1997 Jelic ..... 160/84.04
6,044,523 A * 4/2000 Ortega ..... 16/442
6,792,995 B2 * 9/2004 Judkins ..... 160/84.04
6,837,294 B2 * 1/2005 Cheng et al. ..... 160/84.04
8,186,489 B2 * 5/2012 Zimmer et al. ..... 188/265
8,245,756 B2 * 8/2012 Cheng et al. ..... 160/170

* cited by examiner

*Primary Examiner* — Blair M Johnson

(57) ABSTRACT

An elastic cord device for use in cooperation with a window covering device of the type having a plurality of pulleys, a plurality of housings, a plurality of lift cords extending from a head rail, the lift cords used to raise and lower a window covering material. The elastic cord device has a spiral helical shape. The elastic cord device has a first end and a second end. The first end of the elastic cord device attaching to the lift cords of the window covering device. The second end of the elastic cord device is exposed and is accessible so that the elastic cord device can be pulled to raise and lower the window covering material.

A window covering device of the type having an elastic cord device, the elastic cord device attaching to the free ends of the lift cords of the window covering device.

20 Claims, 4 Drawing Sheets

CORD SAFETY DEVICE FOR WINDOW COVERINGS

CROSS-REFERENCE TO RELATED APPLICATIONS

This application claims the benefit of provisional patent application Ser. No. 61/690,701, filed 2012 Jul. 2 by David Louis Jaggli.

BACKGROUND OF INVENTION

In order to raise or fold up a cord operated venetian blind, or any other type of cord operated window covering, the cords are pulled downwardly which will increase the length of the cords that are exposed. Exposed cords pose a hazard for infants and young children. Efforts have been made to reduce the strangulation hazard posed by the lift cords on window coverings such as venetian blinds. One solution has been to separate the lift cords and attach a tassel to the end of each lift cord to keep the ends of the lift cords from entangling. Other solutions have been break away lift cords. There is still a hazard with these types of solutions because the lift cords are still accessible. There are some window coverings such as venetian blinds and roman shades manufactured that are cordless for safety but these types of cordless blinds or window coverings are approximately four to eight times more expensive and almost always have to be special ordered. Out of necessity, to save money, I invented an affordable cord safety device for window coverings to protect my children from this hazard. My invention keeps the lift cords in the head rail area; therefore they are out of the reach of infants and young children. My invention also allows the lift cords to remain equalized for level operation of the window covering. When you buy a window covering such as a venetian blind you need to cut and adjust the length of the lift cords but with my invention the cord automatically adjusts therefore making installation easier. Preferably my invention will be attached or installed during manufacturing.

BRIEF DESCRIPTION OF DRAWINGS

Window covering in this description refers to window coverings of the type having a plurality of pulleys, a plurality of housings, a plurality of lift cords extending from a head rail the lift cords used to raise and lower a window covering material.

DETAILED DESCRIPTION

Elastic cord device 2 is for use in cooperation with a window covering device of the type having a plurality of pulleys, a plurality of housings, a plurality of lift cords extending form a head rail the lift cords used to raise and lower a window covering material.

Figure 1:
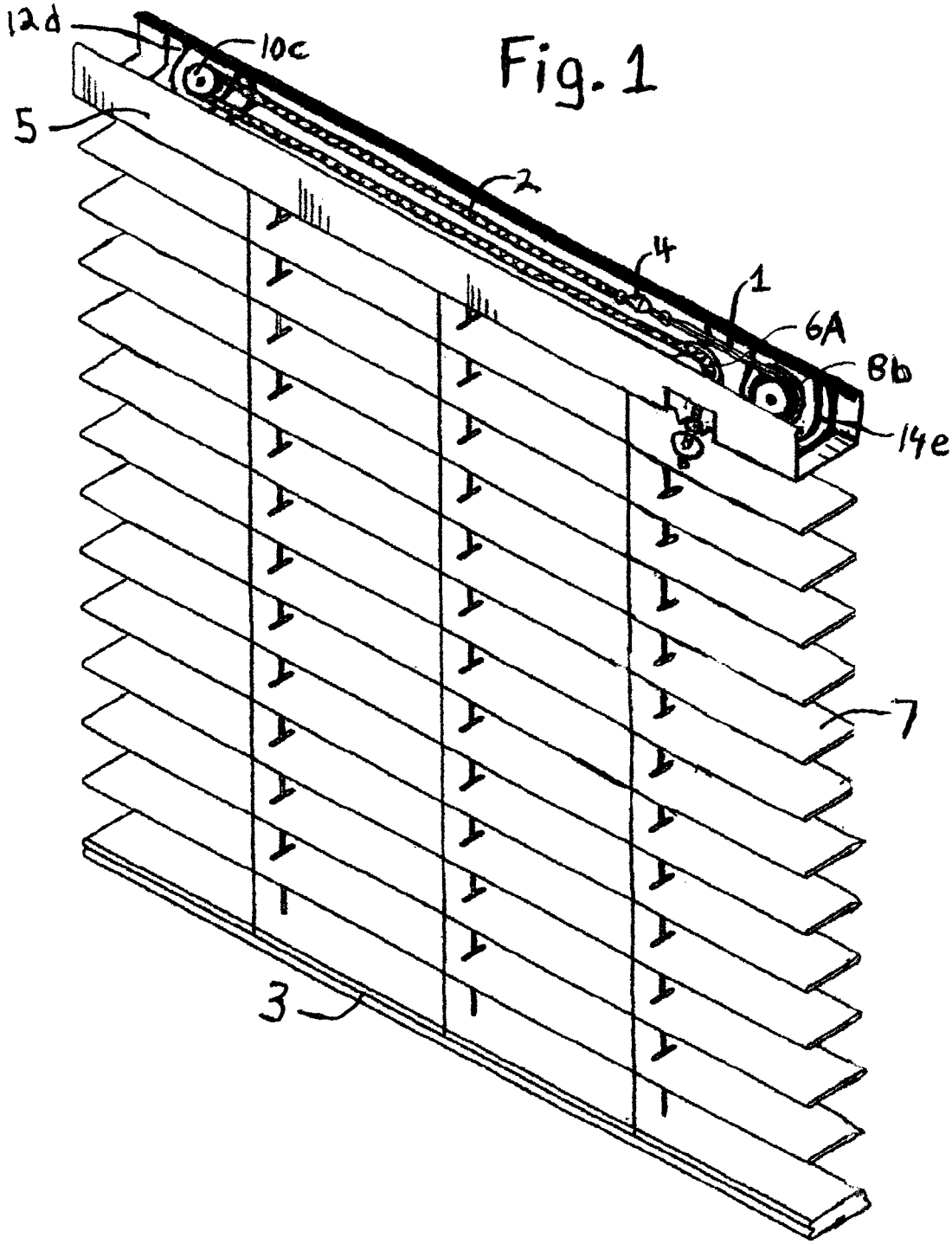
FIG. 1 is an angled overhead view of a window covering in the lowered position.

FIG. 1 shows an angled overhead view of window covering material 7 in a lowered position, head rail 5, bottom rail 3, housing 12*d*, pulley 10*c*, elastic cord device 2, swivel 4, lift cords 1, pulley 6A, pulley 8*b*, housing 14*e*.

Figure 2:
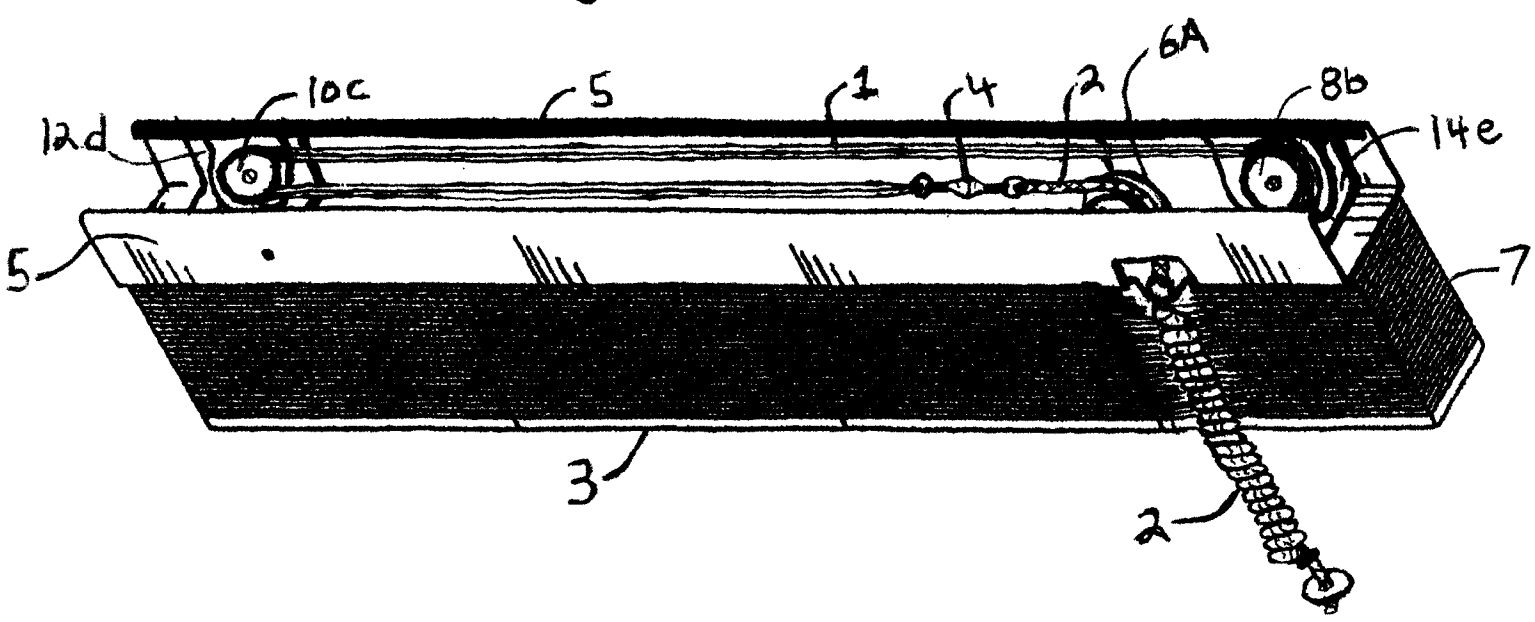
FIG. 2 is an angled overhead view of a window covering in the raised position.

FIG. 2 shows an angled overhead view of window covering material 7 in a raised position, head rail 5, bottom rail 3, housing 12*d*, pulley 10*c*, elastic cord device 2, swivel 4, lift cords 1, pulley 6A, pulley 8*b*, housing 14*e*.

Figure 3:
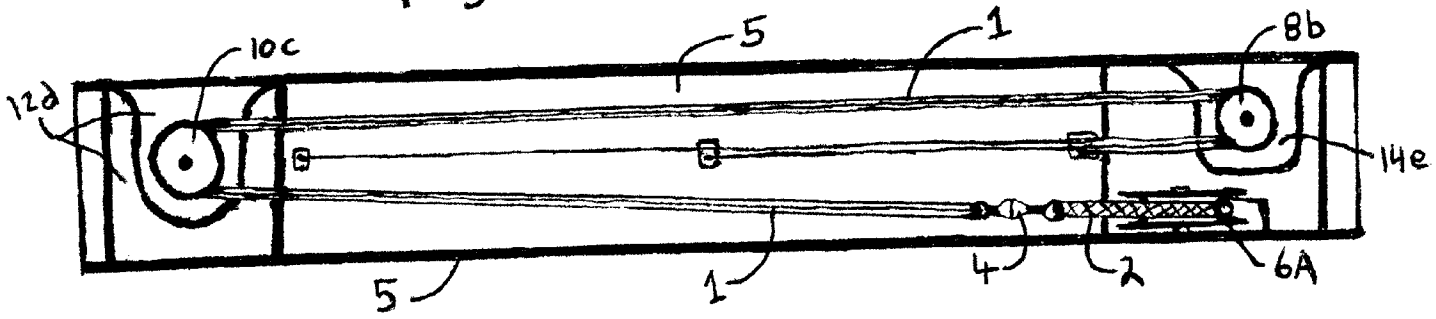
FIG. 3 is an overhead view of a head rail of a window covering in the raised position.

FIG. 3 shows an overhead view of head rail 5 when the window covering material is in a raised position, housing 12*d*, pulley 10*c*, elastic cord device 2, swivel 4, lift cords 1, pulley 6A, pulley 8*b*, housing 14*e*.

Figure 4:
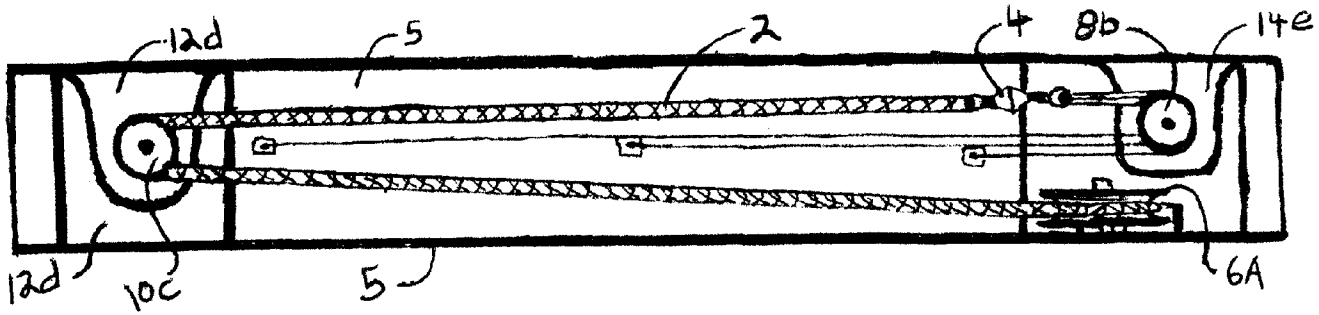
FIG. 4 is an overhead view of a head rail of a window covering in the lowered position.

FIG. 4 shows an overhead view of head rail 5 when the window covering material is in a lowered position, housing 12*d*, pulley 10*c*, elastic cord device 2, swivel 4, lift cords 1, pulley 6A, pulley 8*b*, housing 14*e*.

Figure 5:
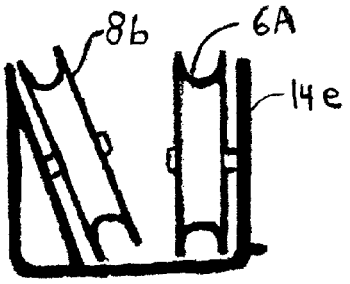
FIG. 5 is a side view of pulleys and housing.

FIG. 5 shows a side view of housing 14*e*, pulley 6A, pulley 8*b*.

Figure 6:
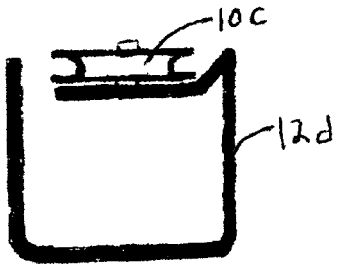
FIG. 6 is a side view of a pulley and housing.

FIG. 6 shows a side view of housing 12*d* and pulley 10*c*.

Figure 7:
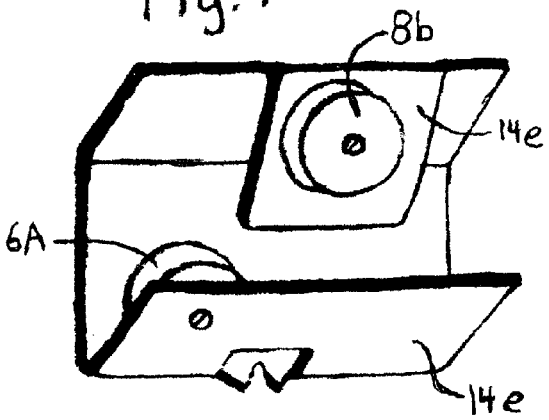
FIG. 7 is an angled overhead view of pulleys and housing.

FIG. 7 shows an angled overhead view of housing 14*e*, pulley 6A, pulley 8*b*.

Figure 8:
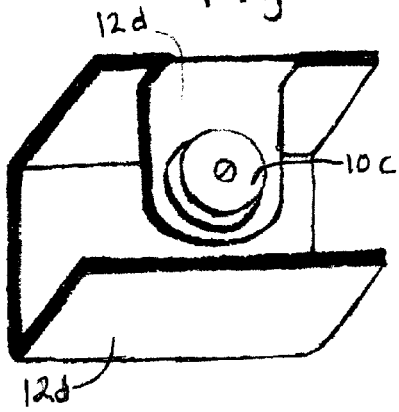
FIG. 8 is an angled overhead view of a pulley and housing.

FIG. 8 shows an angled overhead view of housing 12*d*, pulley 10*c*.

FIG. 1 shows window covering material 7 in the lowered position. When window covering material 7 is in the lowered position, elastic cord device 2 is traversing head rail 5 and exiting head rail 5. Elastic cord device 2 is elongating and allowing the window covering material 7 to be in the lowered position. One end of elastic cord device 2 is outside head rail 5. This end of elastic cord device 2 is what will be pulled in order to raise window covering material 7.

FIG. 2 shows window covering material 7 in the raised position. When window covering material 7 is in the raised position, lift cords 1 are traversing head rail 5. The free ends of lift cords 1 are attached to one end of swivel 4. The other end of swivel 4 is attached to one end of elastic cord device 2. The other end of elastic cord device 2 exits head rail 5. The portion of elastic cord device 2 that is outside head rail 5 springs back to its relaxed state and is out of the reach of infants and young children. The portion of elastic cord device 2 that is outside head rail 5 is what will be accessible in order to lower window covering 7.

FIG. 3 shows an overhead view of head rail 5 when the window covering material is in the raised position. Instead of lift cords 1 exiting head rail 5 they are kept inside head rail 5. Lift cords 1 are directed onto pulley 8*b*, from pulley 8*b* lift cords 1 traverse head rail 5 and are directed onto pulley 10*c*. From pulley 10*c* lift cords 1 traverse back across head rail 5. The free ends of lift cords 1 are attached to one end of swivel 4 and the other end of swivel 4 is attached to one end of elastic cord device 2. Elastic cord device 2 goes onto pulley 6A. Pulley 6A and 8*b* are attached to housing 14*e*. Pulley 10*c* is attached to housing 12*d*.

FIG. 4 shows elastic cord device 2 elongated and traversing head rail 5 when the window covering material is in the lowered position.

FIG. 5 and FIG. 7 show pulley 6A and pulley 8*b* attached to housing 14*e*. Pulley 6A and 8*b* are preferably attached to housing 14*e* by a nut and bolt type fastener.

FIG. 6 and FIG. 8 show pulley 10*c* attached to housing 12*d*. Pulley 10*c* is preferably attached to housing 12*d* by a nut and bolt type fastener.

Housings 14*e* and 12*d* can be different dimensions to fit head rails of different types of window coverings.

Pulleys 8*b*, 6A and 10*c* can be different dimensions to fit the different dimensions of housings 14*e* and 12*d*.

Pulleys 8*b*, 6A and 10*c* can be attached directly to window covering head rails.

Elastic cord device 2 stretches or elongates and traverses head rail 5.

Pulleys 6A, 8*b* and 10*c* guide lift cords 1.

Pulleys 6A, 8*b* and 10*c* also guide elastic cord device 2.

Swivel 4 allows elastic cord device 2 to twist independently of lift cords 1.

Elastic cord device 2 can be different lengths and sizes to fit different types or sizes of window coverings.

Elastic cord device 2 will have a first end and a second end.

Elastic cord device 2 can be made with a central flexible core.

Elastic cord device 2 can have an elasticized outer braided textile covering.

Elastic cord device 2 can be made of strands of rubber or a rubber like synthetic combined with a textile material.

Elastic cord device 2 can be solid or hollow.

Elastic cord device 2 can be made of fiber reinforced composite plastics.

Elastic cord device 2 can be made of metal, plastic or a combination of both.

Elastic cord device 2 can be made with a rubber or rubber like synthetic core.

Preferably elastic cord device 2 will be made of nylon or polyester type cord materials combined with rubber or rubber like synthetic.

Elastic cord device 2 will have a spiral helical shape.

Elastic cord device 2 can stretch or elongate as much as or more than approximately seven times its relaxed state.

Housings 14*e* and 12*d* can be made of metal or plastic.

Housings 14*e* and 12*d* will preferably be made of a durable plastic.

Pulleys 6A, 8*b* and 10*c* can be made of metal, plastic or a combination of both.

Housings 14*e* and 12*d* can be snap fitted into head rails.

Thus, the reader will see that the cord safety device for window coverings provides many advantages.

Many infants and young children die every year from corded window coverings. The cord safety device for window coverings retracts out of the reach of infants and young children, providing a safer environment.

There are still cord operated window coverings on the market and they are more affordable than the cordless window coverings. Parents, apartment owners and business owners will sometimes choose cost over safety. That is precisely why, out of necessity, I invented the cord safety device for window coverings and was able to keep the lift cords out of the reach of my children.

For many years there have been many attempts to remove corded window coverings from the market because of the lift cords hanging down and posing a strangulation hazard. The cord safety device for window coverings lets manufactures still produce cord operated window coverings without the danger of lift cords hanging down, providing a safer window covering. The cord safety device is an affordable and safe way to keep corded window coverings on the market.

The cord safety device for window coverings allows the lift cords to remain equalized for level operation of the window covering.

When a consumer purchases a window covering with the cord safety device attached to the window covering the consumer will not need to cut and adjust the length of the lift cords, making the installation of the window covering easier.

Manufactures can add this cord safety device for window coverings without having to alter the design or structure of their corded window coverings. This provides a cost effective means for providing safer window coverings.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

I claim:

1. An elastic cord device in combination with a window covering device having a window covering material and at least one cord having a first end attached to the window covering material and a second end located and movable along the length of a head rail, at least one guide mounted on said head rail for changing the direction of said at least one cord along the length of said head rail, said at least one cord used to raise and lower said window covering material, said elastic cord device having a spiral helical shape having a first end and a second, free end;

said first end of said elastic cord device being attached to said second end of said at least one cord of said window covering device;

said second, free end of said elastic cord device being accessible away from said head rail to raise and lower said window covering material.

2. The elastic cord device of claim 1 wherein said elastic cord device comprising a central flexible core.

3. The elastic cord device of claim 1 wherein said elastic cord device comprising a rubber or synthetic core and an outer braided textile.

4. The elastic cord device of claim 1 wherein said elastic cord device comprising an elasticized outer braided textile covering.

5. The elastic cord device of claim 1 wherein said elastic cord device comprising fiber reinforced composite plastics.

6. The elastic cord device of claim 1 wherein said elastic cord device comprising of metal, plastic or a combination of both.

7. The elastic cord device of claim 1 wherein said elastic cord device comprising nylon or polyester cord materials combined with rubber or synthetic.

8. The elastic cord device of claim 1 wherein said elastic cord device comprising strands of rubber or a synthetic combined with a textile material.

9. The elastic cord device of claim 1 wherein said first end of said elastic cord device attaches to said at least one cord by means for permitting independent rotation of said elastic cord device.

10. A window covering device comprising a head rail, window covering material adjacent to said head rail, a plurality of pulleys, a plurality of housings each for supporting at least one of said pulleys, a plurality of lift cords, and an elastic cord device, each lift cord having a first end attached to said window covering material and a second end located within said head rail;

said elastic cord device having a spiral helical shape having a first end and a second end;

said first end of said elastic cord device being attached to said second ends of said lift cords of said window covering device;

said second end of said elastic cord device being accessible to raise and lower said window covering material.

11. The window covering device of claim 10 wherein said first end of said elastic cord device attaches to said second ends of said lift cords by means for permitting independent rotation of said elastic cord device.

12. The window covering device of claim 10 wherein said elastic cord device comprising a central flexible core.

13. The window covering device of claim 10 wherein said elastic cord device comprising a rubber or synthetic core.

14. The window covering device of claim 10 wherein said elastic cord device comprising an elasticized outer braided textile covering.

15. The window covering device of claim 10 wherein said elastic cord device comprising fiber reinforced composite plastics.

16. The window covering device of claim 10 wherein said elastic cord device comprising of metal, plastic or a combination of both.

17. The window covering device of claim 10 wherein said elastic cord device comprising nylon or polyester cord materials combined with rubber or synthetic.

18. The window covering device of claim 10 wherein said elastic cord device comprising strands of rubber or a synthetic combined with a textile material.

19. The window covering device of claim 10 wherein said elastic cord device can stretch or elongate as much as or more than approximately seven times a relaxed state thereof.

20. The window covering device of claim 10 wherein the elastic cord device is capable of traversing within said head rail.

* * * * *